United States Patent [19]

Poliak et al.

[11] 3,945,702

[45] Mar. 23, 1976

[54] TWIST-TYPE ELECTRICAL CONNECTOR WITH SAFETY INTERLOCK

[75] Inventors: John M. Poliak, East Meadow; Juan M. Lopez, New York, both of N.Y.

[73] Assignee: Leviton Manufacturing Co., Inc., Little Neck, N.Y.

[22] Filed: Oct. 15, 1974

[21] Appl. No.: 514,554

[52] U.S. Cl. ..... 339/88 R; 339/181 C; 339/189 R

[51] Int. Cl.[2] ..... H01R 13/54

[58] Field of Search .... 339/74 R, 88 R, 88 C, 90 R, 339/90 C, 181 R, 181 C, 188 R, 188 C, 188 T, 189 R

[56] References Cited

UNITED STATES PATENTS

| | | | |
|---|---|---|---|
| 3,123,423 | 3/1964 | Schmitt | 339/88 C |
| 3,292,135 | 12/1966 | Robinson | 339/88 C |

FOREIGN PATENTS OR APPLICATIONS

| | | | |
|---|---|---|---|
| 635,588 | 1/1962 | Canada | 339/90 R |
| 868,053 | 4/1971 | Canada | 339/90 R |

*Primary Examiner*—Roy Lake
*Assistant Examiner*—Mark S. Bicks
*Attorney, Agent, or Firm*—Hanse H. Hamilton

[57] ABSTRACT

The present invention relates to a twist-type electrical connector having an improved interlock. In the connector, a plug and a receptacle are rotated angularly relative to each other to bring electrical contacts into engagement and to prevent accidental separation of the plug and receptacle. Entrance slots in the receptacle receive the male blades and carry detents which engage with a rear edge of at least one of the male blades and hold the blade in its seated or rotated position. The detents also provide an indication as to when proper connections have been established and also, prevent accidental counterrotation of the contacts.

4 Claims, 8 Drawing Figures

10
11
12
13
14
14a
15
16
17
18
18a
19
20
21
22
23
24
25
13½°
4
5
6
7
8

TWIST-TYPE ELECTRICAL CONNECTOR WITH SAFETY INTERLOCK

FIELD OF THE INVENTION

The present invention relates to an improved twist or locking type electrical connector. It relates, more particularly, to a locking type connector in which a male plug and a female receptacle are secured against accidental counterrotation relative to each other once their respective contacts are turned relative to each other into locking engagement.

DESCRIPTION OF THE PRIOR ART

In general, locking type electrical connectors are well known in the art and are commonly used to prevent accidental separation of a plug and a receptacle when a connector is being used. The configuration and spacing of male and female contacts in such connectors is largely dictated by standards adopted by NEMA and parts made by different manufacturers may be interchangeable. However, in connectors of this type, the angular rotation of the plug and receptacle relative to each other to establish an interlock may be very small and it is difficult for the user to be certain that the parts are properly inter-locked and secured to each other. In the connector illustrated herein, this angular movement is in the order of 13½°.

OBJECTS AND SUMMARY OF THE INVENTION

An object of the present invention is to provide a locking type electrical connector having an improved interlock which engages with a plug blade and holds a plug against counterrotation relative to a receptacle once the parts have been rotated to proper engagement with each other. The interlock also provide an indication when the parts of the connector are in proper electrical engagement with each other.

Another object of the invention is to provide a locking type electrical connector having an interlock which engages with a plug blade and prevents accidental disengagement of the contacts due to vibrations or the like.

A further object of the invention is to provide an electrical connector having an interlock which can be readily formed and which is inexpensive to provide.

Other objects and advantages of the invention will become apparent and will be more clearly understood from the following description when read in connection with the accompanying drawing.

DESCRIPTION OF THE PREFERRED EMBODIMENT

Figures 1, 2, 3, 4, 5, 6, 7, 8:
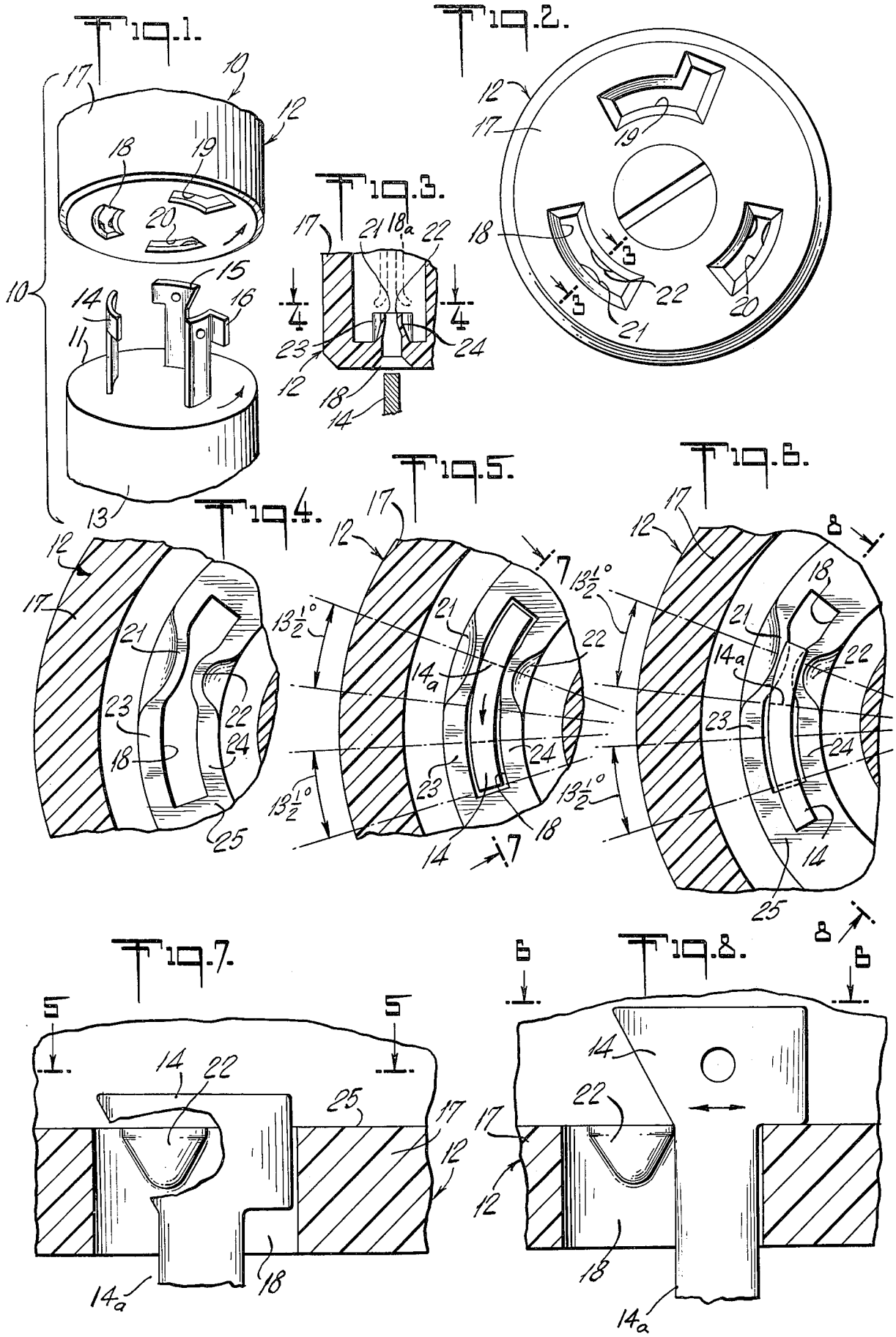
FIG. 1 is an exploded view in perspective showing a male plug and a mating female receptacle of an electrical connector embodying the present invention.
FIG. 2 is a front plan view of the receptacle shown in FIG. 1.
FIG. 3 is a fragmentary view in vertical section taken along line 3—3 of FIG. 2 with certain parts omitted for clarity.
FIG. 4 is a fragmentary view in horizontal section taken along line 4—4 of FIG. 3.
FIG. 5 is a view corresponding to FIG. 4 with a male blade partially inserted in the receptacle prior to turning.
FIG. 6 is a view corresponding to FIGS. 4 and 5 with the male blade inserted in the receptacle after turning.
FIG. 7 is a fragmentary side view in vertical section taken along line 7—7 of FIG. 5.
FIG. 8 is a fragmentary side view in vertical section taken along line 8—8 of FIG. 6.

For purposes of illustration, a connector having a standard NEMA configuration for a 2 pole, 3 wire (grounding type), 480 volt, 20 amperes (A-C) Locking Type Plug and Receptacle has been shown (NEMA Standard of Sept. 4, 1969). In this particular connector, the relative angular movement between the plug and the mating receptacle which brings the contacts into electrical engagement and holds them against separation is about 13½°. Due to the small angular movement, it is frequently difficult to determine that the proper rotation has taken place and the contacts are in proper engagement. One feature of the present invention is that it provides positive assurance that the required rotation has taken place and at the same time, it prevents disengagement of the contacts due to vibration or the like.

However, it will be understood, of course, that the invention is not limited to a particular number of blades and slots or their configuration. Also, it is not limited to the particular angular displacement of the plug relative to the receptacle.

Referring now to the drawing in detail, there is a two-part electrical connector 10 of the locking or twist-type which has a male plug 11 and a female receptacle 12 with mating contacts on opposing faces. The plug 11 comprises a body 13 formed of insulating material, such as nylon, which carries spaced male contact blades or prongs 14, 15 and 16 extending from one face thereof. The other ends of the blades are seated in the connector body and are connected to conductors of a cable (not shown).

The receptacle 12 comprises a body 17 also formed of an insulating material, such as nylon, and has a face thereof containing spaced slots 18, 19 and 20 which communicate with contacts (not shown) to receive the mating blades 14, 15 and 16, respectively, of the plug 11. One of the female contacts **18*a*, as indicated by dotted lines in FIG. 3, is located in the receptacle 12 to engage with the blade 14** and make an electrical connection therewith. The female contacts are in turn connected to conductors of a second cable (not shown).

Initially, the blade 14 enters through the slot 18, as indicated in FIGS. 3 and 7. Opposing projections or detents 21 and 22 extend inwardly from spaced side walls 23 and 24 defining the slot 18 in a rim 25. The detents 21 and 22 are resilient and upon entry of the blade 14, the projections or detents 21 and 22 are flattened by the blade 14 as it enters the slot 18. This forces the detents to a flattened condition as shown in FIG. 5. To permit this, the side walls 23 and 24 together with the detents 21 and 22 may be formed of a flexible material, such as nylon. The detents which extend inwardly relative to the sides of the slot 18 and are normally spaced by a distance less than the thickness of the blade 14 as shown for example in FIGS. 4 and 6. Entrance of the blade 14 into the slot 18 flattens the projections 21 and 22 to the condition shown for example in FIG. 5.

After insertion of the blade, the plug 11 is then rotated in a counter clockwise direction relative to the receptacle 12, as indicated in FIGS. 6 and 8, to a position where the detents 21 and 22 are located behind a vertical rear edge 14*a* of the blade 14. This locks the blade 14 in engagement with the female contacts 18*a* in the receptacle 12 and prevents the plug and receptacle from being counterrotated and pulled apart accidentally. In this position, as shown in FIGS. 6 and 8, the detents 21 and 22 are located behind the vertical rear edge 14*a* of the contact 14 and provide an indication that contacts are properly engaged both electrically and mechanically. As noted above, the angular displacement of the plug and receptacle in the connector illustrated, may be only 13½° as indicated in FIGS. 5 and 6.

The detents 21 and 22 may also be provided for each of the entrance slots 18, 19 and 20, but generally it is not necessary to employ the detents for all of the entrance slots.

While a preferred embodiment of the invention has been illustrated and described, it will be understood that various changes and modifications may be made therein by persons skilled in the art without departing from the scope or spirit of the invention disclosed.

What is claimed is:

1. In a locking type electrical connector having a two part body formed of a flexible insulating material, the combination comprising:

a. a two part connector body comprising a plug and a mating receptacle;

b. said plug and receptacle carrying mating electrical contacts in the form of male blades and female contacts, said blades and contacts being angularly rotatable relative to each other for electrical engagement and disengagement;

c. said receptacle having a face with spaced entrance slots permitting introduction of the blades into said receptacle; and d. detent means located on said face in at least one slot in said receptacle for engaging with a rear edge of one of the blades carried by said plug when the plug and receptacle contacts are rotated into engagement with each other;

e. said detent means being spaced angularly relative to one of the female contacts.

2. In a locking type electrical connector, the combination comprising:

a. a plug having a number of spaced blades extending from a face thereof in spaced relation;

b. a receptacle containing a corresponding number of spaced female contacts for mating engagement with said blades upon angular rotation of the plug relative to the receptacle;

c. said receptacle containing a face with spaced slots communicating with the contacts and for receiving said blades;

d. said slots permitting said blades to be rotated into locking engagement with the female contacts;

e. detent means mounted on said face and extending into at least one of said slots for engaging with one of the blades when the blades and contacts are rotated into locking engagement with each other;

f. said detent means being spaced rearwardly relative to one of the female contacts.

3. In a locking type electrical connector, the combination as defined in claim 2, wherein:

a. the detent means comprise a deformable edge wall located in at least one of the slots in the receptacle;

b. said wall being spaced from an opposing wall of said slot by a distance less than a thickness of the male blade.

4. In a locking type electrical connector, the combination comprising:

a. a two part connector body;

b. said parts being formed of insulating material and comprising a mating plug and receptacle;

c. spaced interengaging electrical contacts carried by said plug and said receptacle;

d. said contacts of the plug comprising spaced blades extending from a face of the plug;

e. said contacts of the receptacle comprising spaced female contacts located within the receptacle;

f. said receptacle containing a face with spaced slots therein communicating with said female contacts to receive said blades;

g. said slots permitting insertion of the blades of the plug into the receptacle and permitting angular movement of the blade relative to the female contacts of the receptacle for locking of the plug to the receptacle with the contacts in electrical engagement; and h. detent means on at least one of the slots for engaging with at least one of the blades when the contacts are in engagement with each other;

i. said detent means comprising a projection on said face extending into said one slot at a point located rearwardly relative to one of the female contacts;

j. said projection being deformable by entrance of one of the male blades into said one slot and being separated from the female contact for engagement with a rear edge of said blade after rotation of the blade into engagement with said female contact.

* * * * *